United States Patent [19]

Jones

[11] 4,274,354

[45] Jun. 30, 1981

[54] PRESSURE MINE SWEEPING

[75] Inventor: Louis F. Jones, Panama City, Fla.

[73] Assignee: The United States of America as represented by the Secretary of the Navy, Washington, D.C.

[21] Appl. No.: 293,226

[22] Filed: Jun. 28, 1963

[51] Int. Cl.[3] ..... B63B 21/66; F42B 22/42

[52] U.S. Cl. ..... 114/244; 114/221 R; 102/402

[58] Field of Search ..... 114/221, 221.1, 235, 114/240, 240 A; 102/18 MS

[56] References Cited

U.S. PATENT DOCUMENTS

| | | | |
|---|---|---|---|
| 2,270,694 | 1/1942 | Yancey | 114/221 A |
| 2,320,986 | 6/1943 | Redmond | 114/221 R |
| 3,012,534 | 12/1961 | Thomas | 114/242 |
| 3,108,246 | 10/1963 | Jones | 114/244 |

FOREIGN PATENT DOCUMENTS

| | | | |
|---|---|---|---|
| 864536 | 1/1941 | France | 114/240 |

*Primary Examiner*—David H. Brown

*Attorney, Agent, or Firm*—Louis A. Miller; Rolla N. Carter

EXEMPLARY CLAIM

1. In a device for sweeping a pressure ground mine, the combination of an elongated tow cable adapted to be towed laterally at a substantially fixed distance above and parallel to the bottom of a seaway, a mop-like array of lines having their proximal ends secured to said tow cable and having the major portion of length, including their trailing ends, dragging on the adjacent to the bottom of the seaway, said lines being individually provided with bristly thrums.

1 Claim, 4 Drawing Figures

PRESSURE MINE SWEEPING

Figure 1:
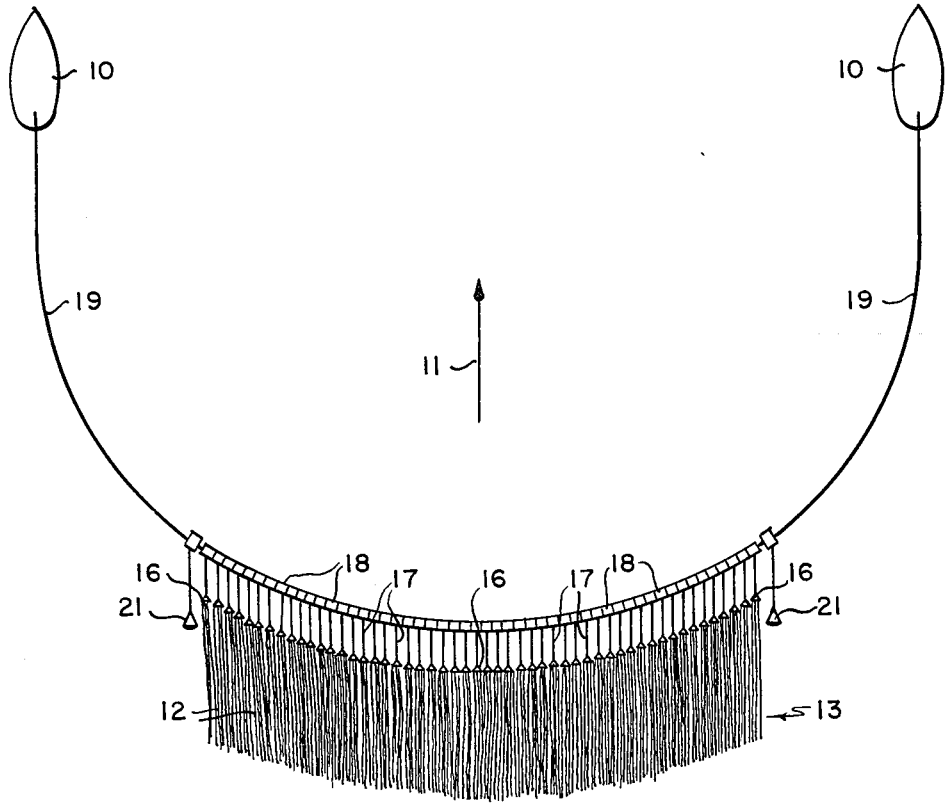

The invention described herein may be manufactured and used by or for the Government of the United States of America for governmental purposes without the payment of any royalties thereon or therefor.

This invention relates to the sweeping of pressure responsive ground mines and more particularly to a method and device for producing at the bottom of a body of water pressure variations of the type and duration to which the mines are thought to be responsive.

Pressure responsive mines, hereinafter referred to simply as pressure mines, are provided with an actuating mechanism which is responsive to a predetermined reduction within a limited time interval in the pressure of the surrounding water for detonating the mine. An example of such a mine firing system is disclosed in U.S. Pat. No. 2,892,404 to Glennon et al.

It is known from the physics of the pressure mine sweeping problem that a change of momentum of water particles near a mine or a decrease in static head is necessary to produce the pressure changes required to actuate pressure influence mines. Since it is a principle in the design of a pressure mine that it must not be fired in response to variations of pressure generated by waves, seiches, or tides, there are conditions on the pressure time relations which will fire the mine and these conditions must be met for successful mine sweeping.

The primary desideratum in pressure mine sweeping can be said to amount to no more than counterfeiting the pressure signature of the type ship for which the mines are designed with means other and less valuable than such a ship, the production when necessary of an accessory signal such as magnetic or acoustic being relatively simple. Ideally, of course, a mine sweep should be able to actuate and thus destroy a mine without being damaged in the process. However, since signatures fall off as some power of the separation distance the amount of power required will differ by several orders of magnitude from that required to generate the same level of signal at the mine with any device outside the normal damage radius, it being evident that when the device is at a great distance a large amount of energy is wasted in changing the momentum of water particles in a large volume of water containing no mines.

In accordance with the present invention a flow of water along the bottom for producing the desired negative pressure is generated at or quite near the bottom thereby reducing the power requirement to a relatively low level. Such a locally generated flow of water along the bottom may be achieved by moving flexible objects along the bottom, e.g., a device in the form of a kitchen mop. As the flexible object (preferably a mop-like array) is towed under water a boundary layer or region in which the water velocity is not zero will be formed on the surfaces of the towed object which results in some of the water being carried along with the towed object thus creating the necessary velocity and pressure fields. The mop-like array is of sufficient length to apply a continuous decreased pressure at a given reference point over which the array is moved for a period of time sufficient to cause a pressure operated mine at said reference point on the bed of a body of water to fire. Stated differently, the array has a length related to the speed at which it is towed such as will effect the pressure time relations at the water bed required to sweep a mine. The width of the path swept equals the width of the array.

An object of the invention is the provision of a new and improved method and device for sweeping pressure responsive marine mines.

Another object is the provision of apparatus for simulating under water the pressure signature of a moving vessel.

A further object of the invention is to provide a device for sweeping a pressure mine which generates a pressure reducing velocity change in the water immediately adjacent a mine thereby minimizing power requirements.

Still another object of the invention is to provide a pressure sweep which is inexpensive to manufacture and is expendable.

The invention itself as well as other objects and advantages thereof will become manifest from the following description of a preferred embodiment thereof when read in connection with the accompanying drawing and its scope will be pointed out in the appended claims.

Figure 2:
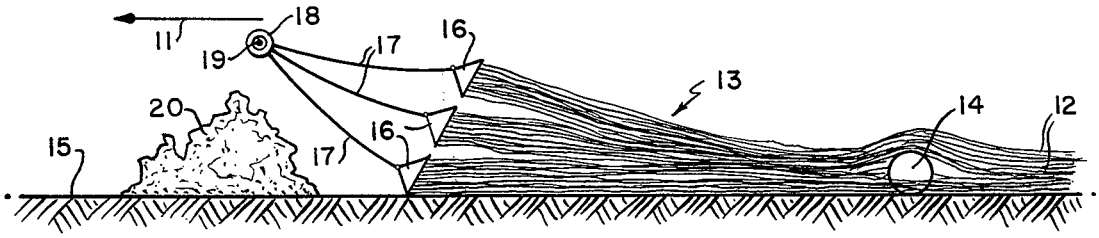
Figure 3:
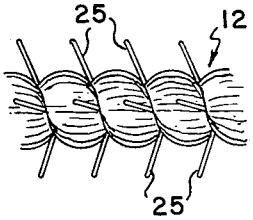
Figure 4:
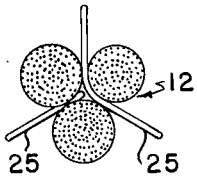

In the drawing:

FIG. 1 is a plan view showing a mine sweeping device of the invention under tow by two boats, FIG. 2 is a side elevation in section of the mine sweeping device of FIG. 1 being towed along a water bed, and FIGS. 3 and 4 are, respectively, side and end views of an individual line which may be utilized in constructing the device in FIGS. 1 and 2.

As shown in FIGS. 1 and 2, a preferred embodiment of the invention indicated generally by the reference numeral 13 comprises a mop-like array of lines 12 secured to a cable 19 being towed submerged in a body of water by two boats 10 in the direction indicated by an arrow 11. The lines 12 are secured in bunches to heavy brackets or mop-heads 16 of sufficient weight or dynamic property to cause the mop-like array 13 to tow along the surface of a water bed 15. As shown, the mop-heads 16 are secured by individual cables 17 to individual collar attachments 18 on the main towing cable 19, the collar attachments 18 being preferably made sufficiently buoyant to render substantially neutrally buoyant the collar 18 and cable 19 assembly. The portion of the tow cable 19 to which the mop-like array of lines 13 is secured is caused to tow a fixed distance, e.g., a few feet, above the water bed 15 so that fouling on a mine 14 or other bottom object 20 will be limited to a few strands 12 which have the tendency to comb out and would not involve the tow cable 19. This height above the bottom of the tow cable 19 may be accomplished in any of a number of well known ways and here indicated as weights 21 secured to the cable 19 at the outer ends of the mop-like array 13 and adapted to drag in contact with the water bed 15. A functionally similiar arrangement could employ the vehicle disclosed in U.S. Pat. No. 2,823,635 to Hagemann in lieu of the weights 21.

The length of the lines 12 is chosen such that the mop-like array 13 will at a selected speed of tow traverse a reference spot such as the mine 14 in a given interval of time to assure that a desired negative pressure is applied to the mine 14 for the time period required to fire the mine 14. For example, if the mines to be swept require a reduced pressure to prevail for 10 seconds in order to fire and the sweep device is to be towed at 6 knots then the minimum length of the lines 12 should be 100 feet. There is no functional limitation on the width of the sweep device so that this dimension may be chosen to balance the convenience of handling against the width of swept path. The streaming and recovery of the sweep device above described are operations requiring known techniques of seamanship not here pertinent.

When the sweep according to the invention successfully actuates a mine firing mechanism the mine will detonate near the trailing end of the mop-like array 13 and it will be a segment of this trailing portion which will be blown upwardly by the force of the explosion of the mine without seriously damaging the remainder of the array 13 or its connection to the tow cable 19. Such limited damage does not seriously affect the efficiency of the sweep and the sweeping operation may continue with a very small probability that a mine will be missed due to the relatively small damaged segment. In any event when considered desirable the repair of such damaged segment or segments is readily accomplished either by tying on the required additional lines 12 or replacing the pertinent mop-heads 16 with mop-heads having undamaged lines 12.

In accordance with the preferred embodiment of the invention the lines 12 whether of fiber or wire, have thrums 25 of bristle inserted between and held in place by the several strands of lines 12 as indicated in FIGS. 3 and 4. These thrums 25 which preferably have a denser population per unit length of line 12 than indicated in these FIGS. 3 and 4 provide a shaggy or roughened surface which tends to entrain the layer of water surrounding the line 12, i.e., the drag is increased, to thereby increase the boundary layer thickness and hence is more efficient in imparting the desired motion of the water as the mop-like array 13 moves along the bottom.

In describing the invention to enable those skilled in the art to understand and practice it, the preferred embodiment has been illustrated only in its essential form since details of fairing, assembly, towing stability, etc., can readily be provided by those skilled in the art and any description of such details would serve to obscure rather than make clear the inventive features constituting the present invention.

While the invention has been described with reference to a particular example presently considered to be a preferred embodiment it will be understood by those skilled in the art that modifications may be made without departing from the invention the scope of which is pointed out in the appended claims.

I claim:

1. In a device for sweeping a pressure ground mine, the combination of an elongated tow cable adapted to be towed laterally at a substantially fixed distance above and parallel to the bottom of a seaway, a mop-like array of lines having their proximal ends secured to said tow cable and having the major portion of length, including their trailing ends, dragging on the adjacent to the bottom of the seaway, said lines being individually provided with bristly thrums.

* * * * *